US006089319A

United States Patent [19]

Singleton

[11] Patent Number: 6,089,319

[45] Date of Patent: Jul. 18, 2000

[54] WHIPSTOCK

[75] Inventor: Teme F. Singleton, Houston, Tex.

[73] Assignee: Weatherford/Lamb, Inc., Houston, Tex.

[21] Appl. No.: 09/162,469

[22] Filed: Mar. 23, 1998

[51] Int. Cl.[7] ..... E21B 29/06

[52] U.S. Cl. ..... 166/298; 166/117.5; 166/208

[58] Field of Search ..... 166/117.5, 117.6, 166/208, 217, 298, 181; 175/257, 258

[56] References Cited

U.S. PATENT DOCUMENTS

| | | | |
|---|---|---|---|
| 1,804,819 | 5/1931 | Spencer, Jr. et al. | 175/81 |
| 1,821,426 | 9/1931 | Dumm et al. | 1661/117.6 |
| 1,951,638 | 3/1934 | Walker . | |
| 2,100,684 | 11/1937 | Carroll | 166/67 |
| 2,147,585 | 2/1939 | Trotter | 175/83 |
| 2,312,656 | 3/1943 | LeBus . | |
| 2,506,799 | 5/1950 | Livingston . | |
| 2,766,010 | 10/1956 | Hester . | |
| 3,175,617 | 3/1965 | North . | |
| 3,215,204 | 11/1965 | Sims . | |
| 3,351,144 | 11/1967 | Park | 175/269 |
| 3,516,703 | 6/1970 | Templeton | 294/86.17 |
| 3,902,361 | 9/1975 | Watson | 73/151 |
| 4,007,797 | 2/1977 | Jeter | 175/26 |
| 4,043,392 | 8/1977 | Bazda | 166/217 |
| 4,733,732 | 3/1988 | Lynch | 175/9 |
| 4,928,767 | 5/1990 | Jelsma | 166/377 |
| 5,086,852 | 2/1992 | VanBuskirk | 175/269 |
| 5,131,467 | 7/1992 | Osborne et al. | 166/117.6 |
| 5,311,941 | 5/1994 | Baugh | 166/208 |
| 5,484,017 | 1/1996 | Coon | 166/117.5 |
| 5,522,461 | 6/1996 | Carter et al. | 166/298 |
| 5,531,271 | 7/1996 | Carter | 166/117.6 |
| 5,595,247 | 1/1997 | Braddick | 166/297 |
| 5,620,051 | 4/1997 | Carter et al. | 166/298 |
| 5,678,634 | 10/1997 | Rehbock et al. | 166/377 |
| 5,787,987 | 8/1998 | Forsyth et al. | 166/313 |
| 5,806,596 | 9/1998 | Hardy et al. | 166/298 |
| 5,806,614 | 9/1998 | Nelson | 175/61 |
| 5,813,465 | 9/1998 | Terrell et al. | 166/298 |
| 5,829,518 | 11/1998 | Gano et al. | 166/55.7 |
| 5,832,997 | 11/1998 | White et al. | 166/117.6 |
| 5,833,003 | 11/1998 | Longbottom et al. | 166/298 |
| 5,842,528 | 12/1998 | Johnson et al. | 175/45 |
| 5,845,707 | 12/1998 | Longbottom | 166/50 |
| 5,845,710 | 12/1998 | Longbottom et al. | 166/313 |
| 5,845,722 | 12/1998 | Makohl et al. | 175/101 |
| 5,853,049 | 12/1998 | Keller | 166/380 |

FOREIGN PATENT DOCUMENTS

| | | |
|---|---|---|
| 2294714 | of 0000 | United Kingdom . |
| 2289298 | of 1994 | United Kingdom . |
| 2304760 | of 1995 | United Kingdom . |
| 93 401501 | of 1993 | WIPO . |
| WO 95/33910 | of 1995 | WIPO . |

OTHER PUBLICATIONS

A–1 Bowen Whipstocks, A1 Bit & Tool Co., 1988.
Powertork Gear Couplings, System Components Inc., 1996.

*Primary Examiner*—Frank Tsay
*Attorney, Agent, or Firm*—Guy McClung

[57] ABSTRACT

A wellbore tool locating system has been invented which includes a friction engager for engaging an interior of a wellbore tubular, an outer sleeve connected to the friction engager and having a slot therethrough for controlling movement of an inner body an inner body movably disposed within the outer sleeve for both rotating and up-and-down movement therein, a lug projecting out from the inner body and movably disposed in the slot, at least one key in a recess in the body, the at least one key urged outwardly by a spring therebehind, the at least one key initially held in its recess by contacting an inner surface of the outer sleeve, at least one window through the outer sleeve, and the inner body movable to align the at least one key with the at least one window to release the at least one key to move from its recess to project through the at least one window and beyond an exterior surface of the outer sleeve for engaging a profile on the wellbore tubular.

33 Claims, 12 Drawing Sheets

FIG. 1A
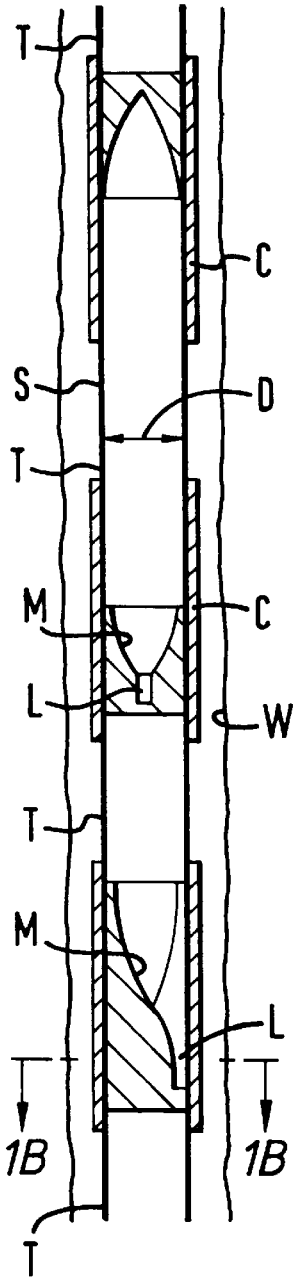
FIG. 2A
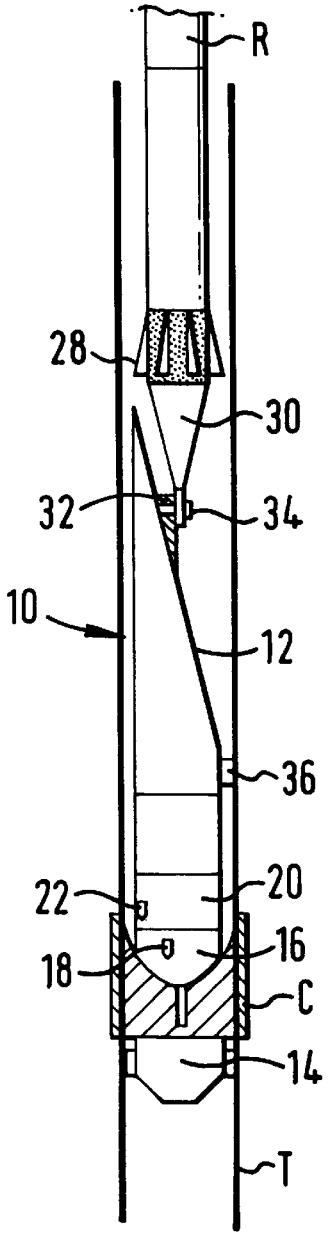
FIG. 2B
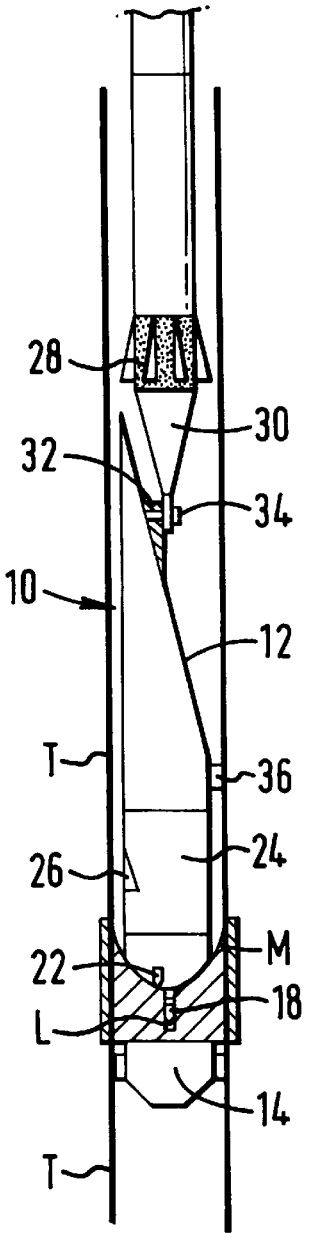
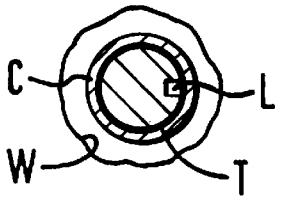
FIG. 1B 203
211
202
200
122
125
137
134
124
128
120
135
60
219
200
202
126
130
123
102
102
104
112
113
114

FIG. 9
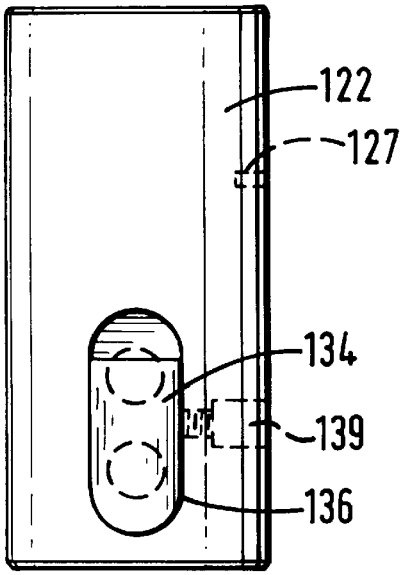
FIG. 10A
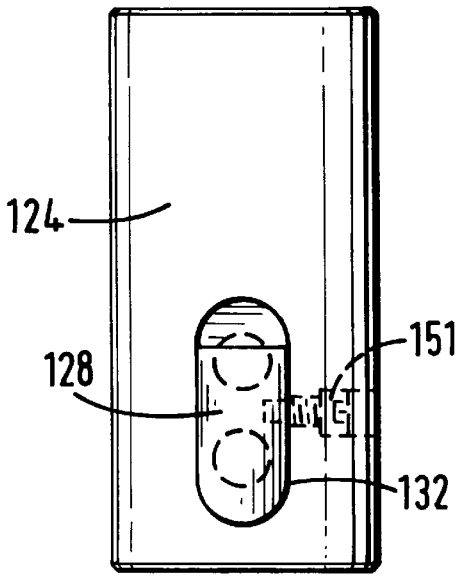
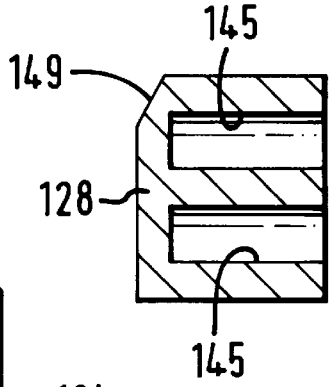
FIG. 10C
FIG. 10B
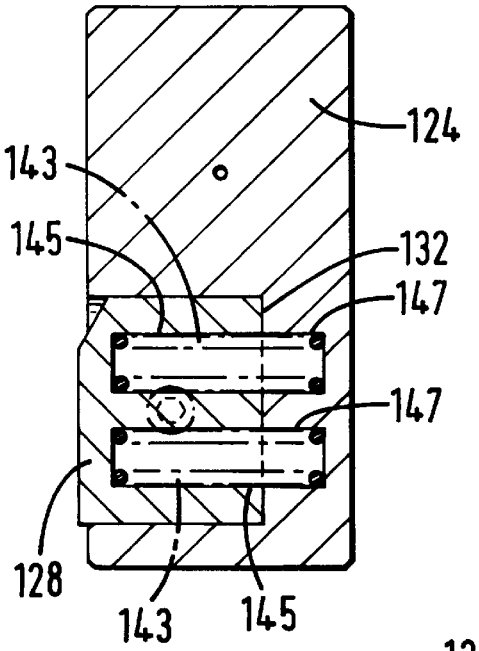
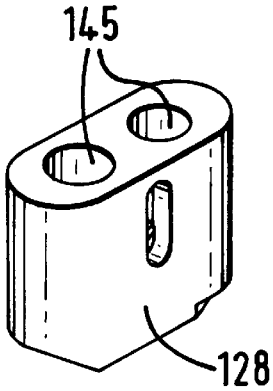
FIG. 10D
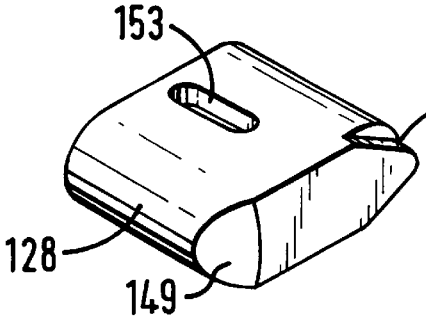
FIG. 10E

WHIPSTOCK

BACKGROUND OF THE INVENTION

1. Field of the Invention

The present invention is directed to wellbore locating systems, such systems which include a setting mechanism; to whipstocks; to whipstocks orientable with and with respect to locator areas in a tubular string; and to methods of their use.

2. Description of Related Art

The prior art discloses a wide variety of wellbore locator systems, whipstocks and diverters for directing a mill in a tubular string in a wellbore. Typically such whipstocks need to be correctly oriented in a tubular member so that milling is effected at a desired location therein. In many instances to insure that a whipstock remains stable and properly located, it is anchored in place with a variety of known anchoring mechanisms or devices. It is important that an anchor be activated only at a desired location in the tubular string and that an anchor not be activated prematurely.

SUMMARY OF THE PRESENT INVENTION

The present invention, in certain aspects, discloses a wellbore system that includes a tubular string within the wellbore that has one or more action areas formed integrally of a tubular member in the string or an action area in a coupling connecting two of the tubular members. A wellbore locator system according to the present invention has one or more selectively projectible members for selectively engaging an action area at a known location in a wellbore to orient and/or set the wellbore locator system and, in one aspect, any items or apparatuses connected to the locator system. In one aspect, a setting or anchoring mechanism is connected to the locator system for actuation thereby or therewith to effect setting or anchoring of an item or apparatus. In certain embodiments the action areas of the tubular members or couplings are slots or profiles that are configured, sized, and disposed so that the action areas do not block or intrude into the passage through tubulars coupled by the coupling.

The action area, in one aspect, includes a slot for receiving and releasably holding one or more corresponding keys that are selectively extensible from one or more bodies of the wellbore locator system. By movement of an inner tool body and related members which initially house the keys, the keys are selectively projected through a tool body slot and through corresponding windows in a sleeve surrounding the tool body to effect system orientation and setting.

A first lower key is movable into the action area slot thus indicating that an item, e.g. but not limited to a whipstock, is oriented in a particular known position when the location of the slot with respect to the earth's surface and when the orientation of the slot radially with respect to the wellbore is known. A second upper key is projectable to move into the slot above the first lower key, allowing tubulars housing the keys to then be contacted by a trip bar to activate a setting mechanism. An optional friction block mechanism (which may be any suitable mechanism for sufficiently engaging an interior tubular wall so that portions of the system are movable with respect to other portions by picking up on a wellbore string to which the whipstock is connected, e.g. but not limited to a friction block mechanism) engages an inner wall of a tubular string (e.g. but not limited to casing) so that inner parts of the system may be picked up and rotated to move the key housings with respect to the outer sleeve to free keys for movement outwardly from the tool body slot through sleeve windows and into operative positions for co-action with a coupling slot. Alternatively, the key(s) in the coupling transmit weight to the coupling and the coupling supports the weight of the system and anything connected thereto.

The first lower key is movably connected to and partially within a first tubular member held within the outer sleeve which has a first window to and through which the first lower key is extendable so that the first lower key moves through the window to project therefrom for engaging the coupling slot. The second upper key is movably connected to and partially within a second tubular member which rests on the first tubular member. The outer sleeve has a second window to which the second tubular member is movable so that the second upper key is movable to and through the second window to project therefrom for engaging the slot. The keys are, in one aspect, initially offset so that the first lower key enters the slot before the second upper key enters the slot (i.e., the first and second tubular members are positioned so that the keys are offset). The key offset feature, and thus the sequential key movement into the slot, provides a fail-safe feature that prevents actuation of a setting mechanism until correct orientation has been achieved. In one aspect the keys are spring-loaded outwardly and initially positioned in recesses in their respective tubular members.

The first lower key deploys and then moves on and into the coupling slot and comes to rest therein at a bottom thereof. Thus an item, e.g. but not limited to, a whipstock is positioned and correctly oriented. When the first lower key moves in the slot, then the second upper key—which is spaced apart from and offset from the first lower key—encounters a top of the slot and begins to move down in the slot above the first lower key.

The keys and their respective tubular members are movable with the outer sleeve during run-in into the wellbore. The outer sleeve has a lower control slot or channel through which projects a lug projecting outwardly from a lower tubular which is part of a tubular member. Co-action of the outer sleeve on the lug effects the various key deployments, positionings, and key sequenced entry into the coupling slot so that correct orientation is achieved and setting of an anchor within the whipstock is accomplished following orientation.

In one aspect, the control slot is like that of a muleshoe, i.e., it has a top tapered lip or entryway on both sides to facilitate direction of a key into a lower slot portion. The key contacts the lip, moves on and down the lip, and is thereby directed into the lower portion of the slot. In one aspect, the lip and lower slot portion are disposed inside the tubular string, but outside of the regular inner diameter of the tubular string so that the bore through the tubular string is not restricted by the coupling or by the slot.

In one embodiment the present invention discloses a system with a tubular string extending down into an earth wellbore cased with a casing string; one or more locating areas and/or couplings in the casing string; an optional mill attached to the tubular string; an optional whipstock to which the optional mill is releasably connected or which is connected to the tubular string if no mill is used; a setting mechanism, device or anchor for emplacing the whipstock and securing it in a desired location and position; and a wellbore locator system as described herein for co-action with the one or more locating areas and/or couplings. In one aspect a flexible member, flexible pipe, flexible joint or flexible coupling is used in the system to accommodate bending or flexing thereof; in one aspect, such a flexible item is disposed between the setting mechanism and the wellbore locator system. Any suitable known whipstock, mill, milling system, and/or setting mechanism may be used with such a system.

It is, therefore, an object of at least certain preferred embodiments of the present invention to provide:

New, useful, unique, efficient, nonobvious devices and methods for locating items in a wellbore, for setting or anchoring items therein, and/or for a whipstock system tripped by extendable keys that enter an action area at a known location in a tubular in a wellbore;

Such a system in which tripping of an anchor or setting mechanism occurs only following correct system orientation;

Such a system in which spaced-apart offset keys are employed to effect sequenced system orientation and anchor setting; and Methods of using such systems.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a side cross-section view of a tubular string according to the present invention.

FIG. 1B is a cross-section view along line 1B—1B of FIG. 1A.

FIG. 2A–2F are schematic side cross-section views of steps in the operation of a system according to the present invention.

FIG. 9 is a side view of an upper tubular member for housing an extendable key of the system of FIG. 3A.

FIG. 10A is a side view of an upper tubular member for housing an extendable key of the system of FIG. 3A.

FIG. 10B is a side cross-section view of the tubular member of FIG. 10A.

FIG. 10C is a side cross-section view of the key of the tubular member of FIG. 10A.

FIGS. 10D and 10E are perspective views of the key of FIG. 10C.

DESCRIPTION OF EMBODIMENTS PREFERRED AT THE TIME OF FILING FOR THIS PATENT

Figure 2C:
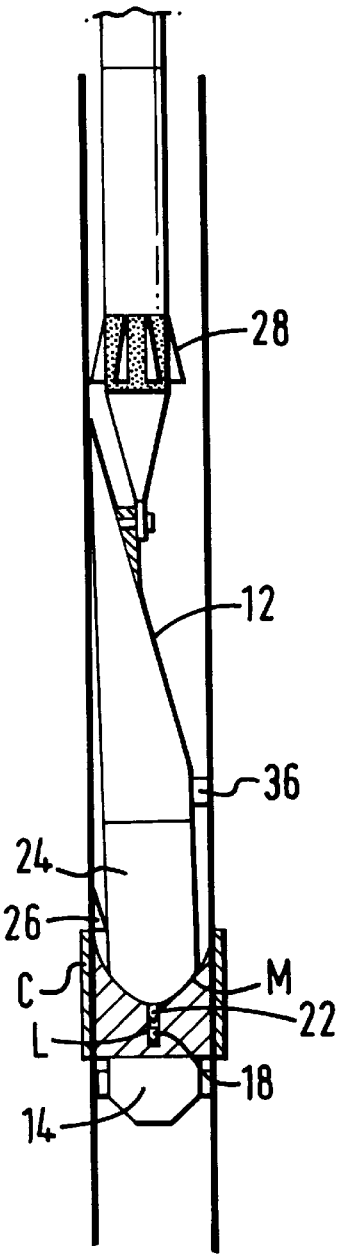

Referring now to FIGS. 1A and 1B, a wellbore tubular string S disposed in an earth wellbore W has a plurality of couplings C interconnecting tubulars T of the string S. Each coupling C has a mule shoe profile M and slot L which, as shown in FIG. 1B do not project further inwardly than the inner diameter D of the tubulars T. Each coupling C is at a known location in the wellbore W. This location may be determined using known devices and methods. The couplings, and therefore their respective slots, may be disposed with any orientation. The orientation of a slot in a particular coupling may be determined with known techniques and devices.

FIGS. 2A–2F show schematically a system 10 according to the present invention approaching with a whipstock 12, friction device 14, first tubular member 16 with first lower key 18, second tubular member 20 with second upper key 22, and setting mechanism 24 with slips 26. Optionally, a mill system 28 is used attached to a tubular string R (shown in FIG. 2A) with at least one mill, including but not limited to, a starting mill 30 releasably secured to a lug 32 of the whipstock 12 with a shear stud 34.

FIG. 2A shows the system 10 approaching one of the couplings C. The friction device 14 has engaged an inner wall of a tubular T so that an inner portion of the system that includes the tubular members 16 and 20 can be lifted with respect to an outer sleeve (not shown; described with respect to the embodiment of FIG. 3A, below). The outer sleeve is attached to the friction device 14. As shown in FIG. 2A neither key has yet contacted the muleshoe profile M of the coupling C. The coupling C does not support the weight of the system 10 and the system is not fixed to the coupling C. The tubular T is part of a string disposed in a wellbore like the wellbore W (FIG. 1A).

As shown in FIG. 2B, the inner portion of the system 10 has been lifted and rotated so that the first lower key 18 is released to project through a window in the outer sleeve (as described below) to engage the muleshoe profile M and move down in the slot L, thus assuring correct orientation of the whipstock 12.

Referring now to FIG. 2C, the second upper key 22 has projected through a corresponding sleeve window (not shown) and moved down in the slot L. The alignment of the upper and lower keys followed by additional downward movement of the keys in the slot permits setting of the slips 26. The lower key 18, its rotatable member 16 along with the upper key 22 and its rotatable member 20 do not move down further once in the bottom of the slot L. Inner parts of the system move down so that the trip bar contacts the upper key's tubular member 20 shearing a roll pin (as described below) and effecting setting of the slips 26. Tripping of the setting mechanism 24 also moves the whipstock 12 on a fulcrum slip 36. The second upper key 22 is positioned as is the second tubular member 20 so that such setting cannot occur until the second upper key has moved down to the muleshoe profile. Thus premature whipstock setting is prevented and whipstock setting occurs only following correct orientation of the whipstock by the action of the first lower key 18. To prevent the slot L, the muleshoe profile M, and the coupling C from bearing the weight of the system and force thereon, overtravel is provided for with an extension of an upper window in a tool body through which the upper key projects and an extension of a control slot in an outer sleeve —all as described below in detail, e.g. with respect to FIGS. 3A–3F; i.e. the windows and slot extension prevent system lock-up.

It is within the scope of this invention to use any known suitable whipstock with any known suitable whipstock setting device, mechanism, or apparatus and/or packer or anchor packer.

Figure 2D:
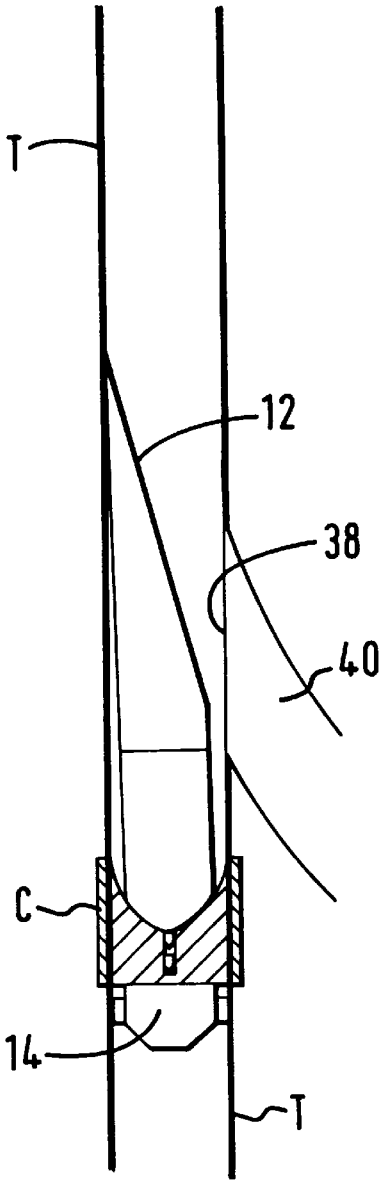
Figure 2E:
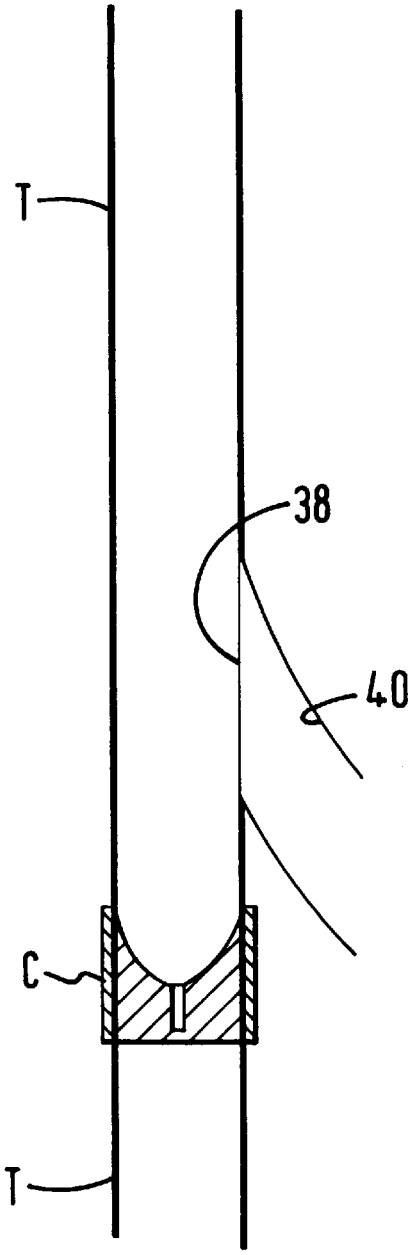

FIG. 2D shows a window 38 milled through the tubular T (e.g. but not limited to casing) using any known mill or milling system diverted by the whipstock 12 and a lateral or sidetracked bore 40 created with any known device or system useful for making such a bore. FIG. 2E shows the completed bore 40 and the whipstock 12 removed from the tubulars T. It may be removed by any suitable known removal device or system and/or it may be milled out. Passage and/or flow through the tubulars T is now possible again.

Figure 2F:
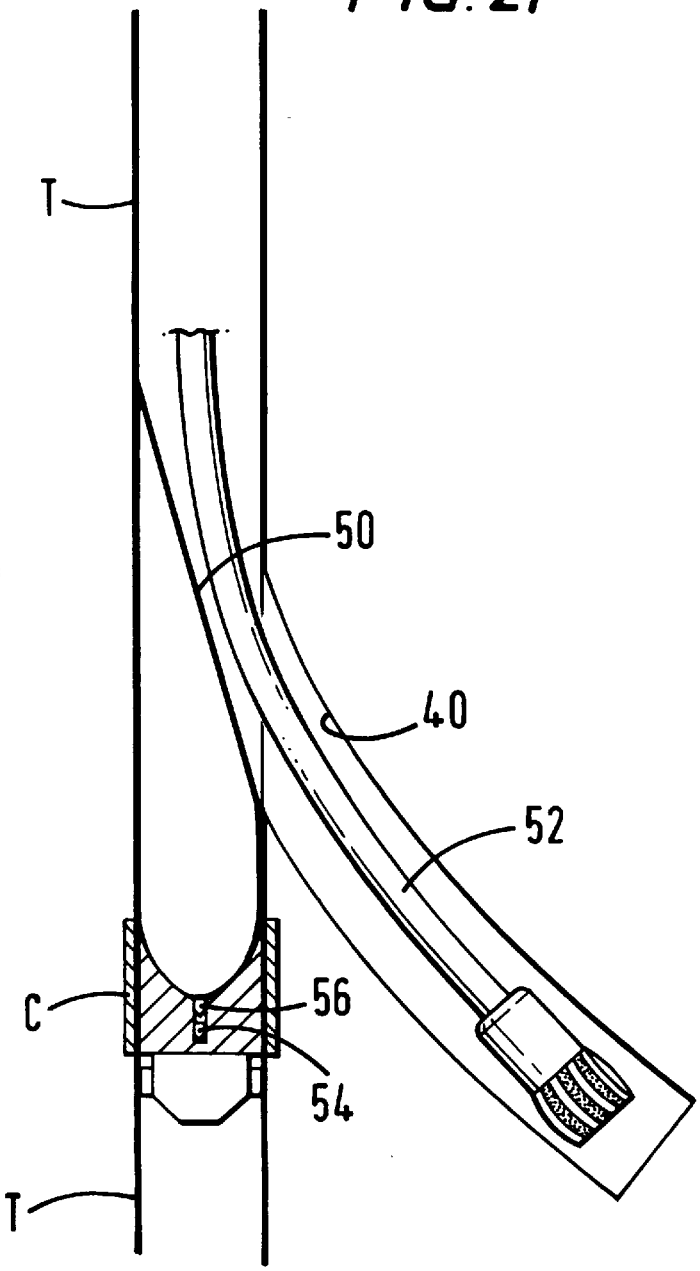

FIG. 2F shows a diverter whipstock 50 installed in the tubulars T of FIG. 2E. The diverter whipstock 50 provides a diverter device for subsequent operations in the bore 40, including, but not limited to, e.g. further drilling with a drill system 52 to extend and/or re-direct the bore 40. The diverter whipstock may employ a single key (not shown) to achieve correct orientation and setting; or, alternatively, it may have a set of keys 54, 56 (like the keys 18, 22 described above) and related apparatus, as described above, for whipstock orientation and setting. Alternatively, the whipstock 12 may be left in place for further operations.

Figure 4A:
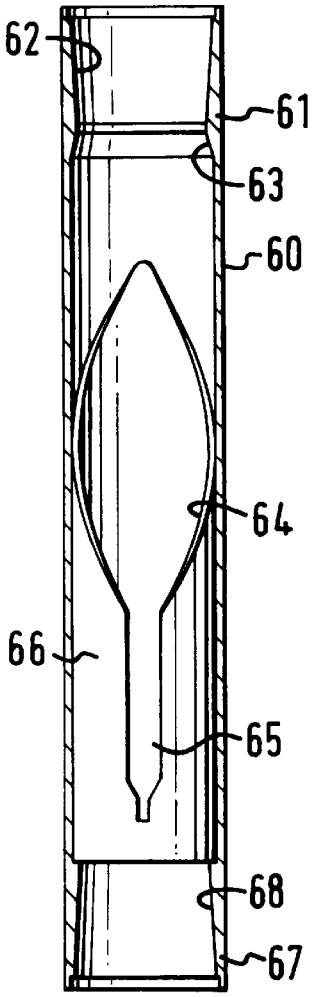
FIGS. 4A and 4B are side views in cross-section of a coupling according to the present invention.
Figure 4B:
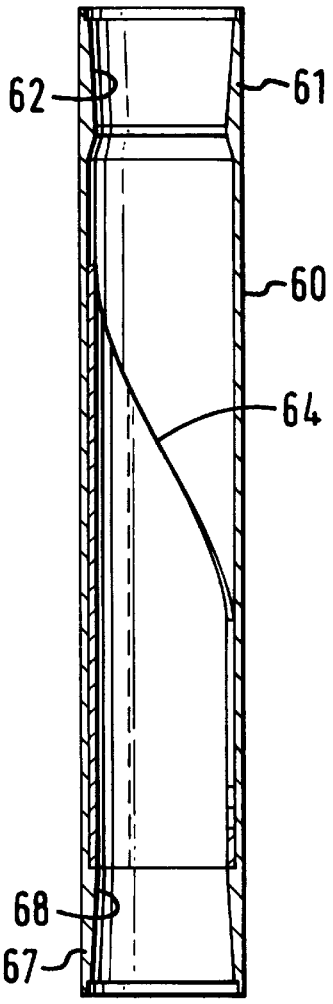

FIG. 4A and 4B show a coupling 60 (one possible embodiment of a coupling C as in FIG. 1A) with an upper end 61 having inner tapered surfaces 62 and 63, a lower end 67 with an inner tapered surface 68 for facilitating movement of the keys 18 and 22 and other wellbore apparatuses therethrough. An inner muleshoe profile 64 with a slot 65 is formed in a wall 66 of the coupling 60.

FIGS. 3A–3F show a sequence of steps in the operation of a system 100 according to the present invention which can be used as the system 10 in FIGS. 2A–2D. The system 100 has a friction mechanism 102 with a plurality (one or more, four in the system 100) of spring-loaded blocks 104 constantly urged outwardly by springs 106 from recesses 108 in a body 110. The outer surfaces of the blocks 104 may be wholly coated with hardfacing material or intermittently striped therewith. A lower end 112 of the body 110 has a tapered nose 114 for ease of movement through tubulars of a tubular string. A collar 113 threadedly mated with the nose 114 holds the blocks 104 in place.

An outer sleeve 120 is movably disposed around and encircles a first tubular member 124, a second tubular member 122 and a third tubular member 123. The two tubular members 122 and 124 are not interconnected and the upper one rests on the lower one. The third tubular member 123 is welded to a tool body 125. A lug 126 projects outwardly from the third tubular member 123 into a slot 130 through the outer sleeve 120. A first key 128 is initially held by the inner surface (shown cutaway in FIG. 3A) of the outer sleeve 120 in a recess 132 in the first tubular member 124 and in a window 135 in the tool body 125. A second key 134 is initially held in a recess 136 in the second tubular member 122 by the inner surface of the outer sleeve 120. The keys are extendable through a window 137 in the tool body 125. Springs as the springs 143 in key recesses 145 and body recesses 147 (FIG. 10B) urge the keys outwardly. A screw or bolt 151 extending through the tubular member (122 or 124) projects into a recess 153 in the key and prevents the key from exiting completely from its tubular member.

Figure 3A:
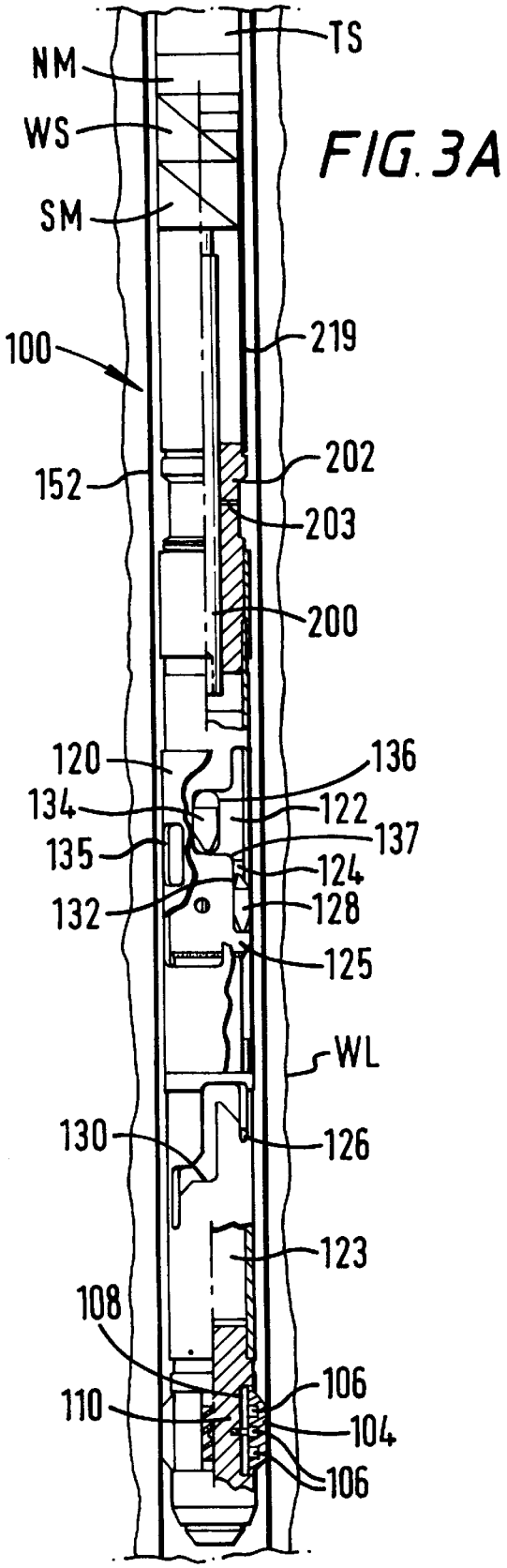
FIG. 3A–3F are cross-section side views of steps in the operation of a system according to the present invention.

A trip bar 200 disposed above a top of the second tubular 122 is interconnected with a whipstock setting mechanism and a whipstock (shown schematically as SM and WS respectively in FIG. 3A). The whipstock WS is releasably attached to a mill M which is connected to a tubular string TS (both shown schematically in FIG. 3A). The string TS extends to the earth surface from a wellbore WL in which the system 100 is to be set. Such a trip bar, setting mechanism, and whipstock are well known in the art (e.g., but not limited to, Weatherford's commercially available "WHIPBACK" whipstock).

The tubular members 122, 123, and 124 are enclosed in the tool body 125. The tubular member 124 is sandwiched between the tubular members 122 and 124 within the tool body 125, but in one aspect, is connected to neither. The third tubular member 123 rests on the body 110 so that lifting the tool body 125 lifts the three tubular members. The trip bar 200 extends through an orientation adapter 202 and is releasably shear pinned thereto with a roll pin 203 that extends through the adapter 202 and into the trip bar 200. The trip bar 200 is movable downwardly once the roll pin is sheared by moving the string is downwardly to contact the top of the second tubular member 122.

FIG. 3A illustrates the system 100 while it is being run through a string of casing 152 in the wellbore WL. Neither key yet projects through its window in the outer sleeve 120. A spline nut 211 secures the tool body 125 to the orientation adapter 202. A pin 207 (see FIG. 3C) releasably holds the upper tubular member 122 to the tool body 125 (pin 207 sheared in FIG. 3E). An upper tubular 219 is connected to the adapter 202. In the remaining FIGS. 3B–3F, the wellbore, casing, tubular string, mill, and whipstock are not shown but are understood to be present as in FIG. 3A.

Figure 3B:
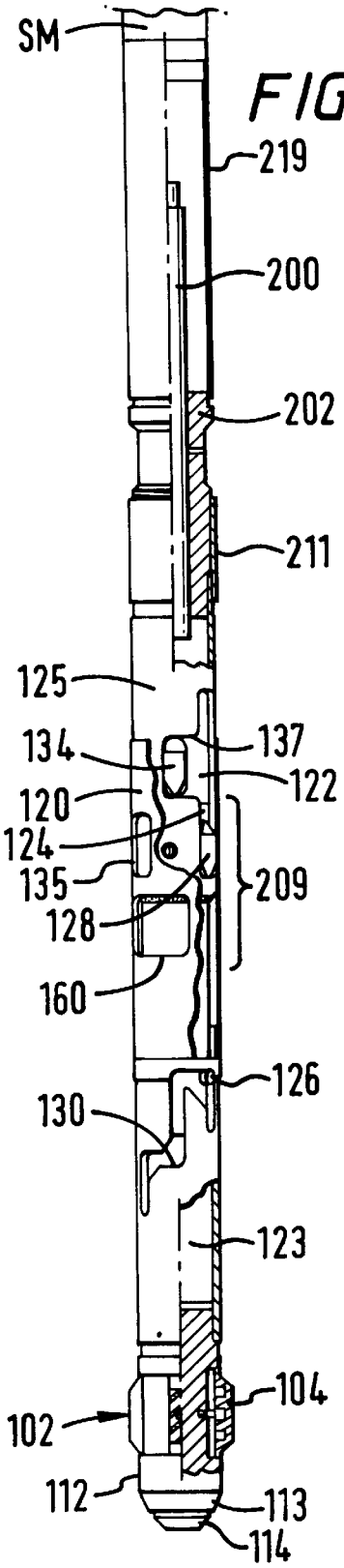

FIG. 3B illustrates the system 100 at a desired location in the wellbore with respect to a coupling 209 (shown schematically only, e.g. like the couplings in FIG. 1A) in the casing string 152 at a known location (e.g. as in FIG. 1A and 2A). At this point the friction blocks 104 sufficiently engage the casing 152. By lifting up on the tubular string TS, all of the following items are moved upwardly with respect to the friction mechanism 102 and the outer sleeve 120 (both of which remain stationary within the casing as the lifting occurs): mill M, whipstock WS, whipstock setting mechanism SM, trip bar 200 (releasably held to the adapter 202 by a roll pin 203 extending through bores 205 in the adapter 202 —see FIG. 7B), orientation adapter 202, spline nut 211, tool body 125, and tubular members 122, 123, and 124. As these items are lifted, the keys 128 and 134 ride up within the interior of the outer sleeve 120 and the lug 126 moves from the position shown in FIG. 3A in the slot 130 to the position shown in FIG. 3B.

Figure 3C:
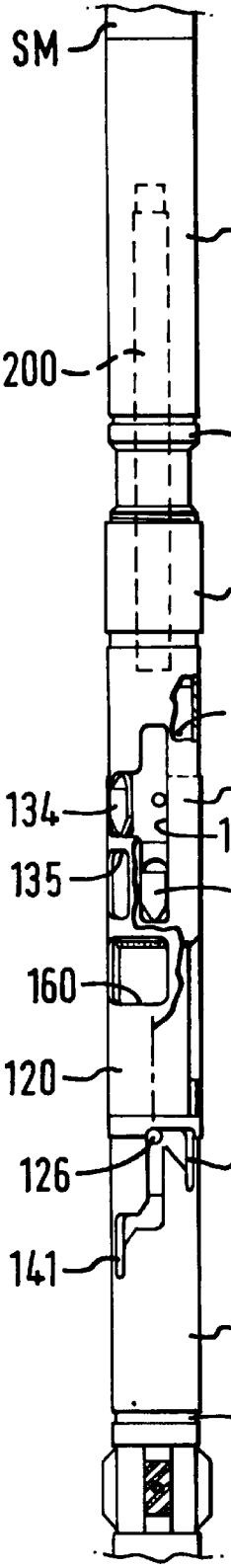

As shown in FIG. 3C the inner parts that were lifted as shown in FIG. 3B are turned to the right by turning the tubular string TS. The outer sleeve 120 remains immobile and the keys 128 and 134 move to a position above their respective windows 160 and 135 respectively in the outer sleeve 120. The lug 126 has moved from the position of FIG. 3B to that of FIG. 3C (i.e. to the left in the figure).

Figure 3D:
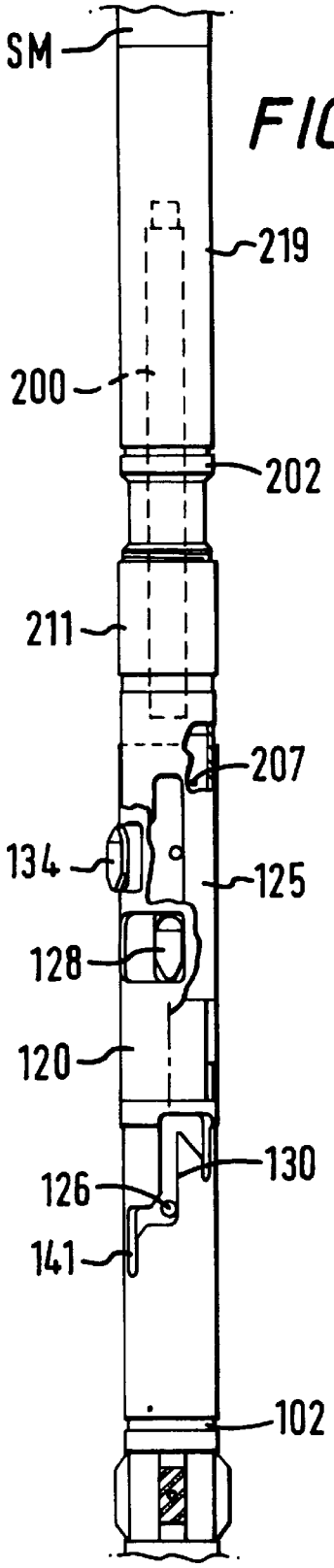

As shown in FIG. 3D, the tubular string TS has been moved down, which moves the keys 128 and 134 down so that they are urged outwardly by their respective springs through the windows 160 and 135, respectively. The downward movement of the tubular string is governed by the downward movement of the lug 126 in the slot 130 from the position shown in FIG. 3C to that of FIG. 3D. Preferably the two keys are urged simultaneously through their respective windows and that the windows are offset so that sequential engagement of the muleshoe slot of the coupling 209 is effected; i.e., in this embodiment, both keys can only project simultaneously. However, in other embodiments of the invention, other window dispositions are envisaged so that sequential outward projection of the keys is possible.

Figure 3E:
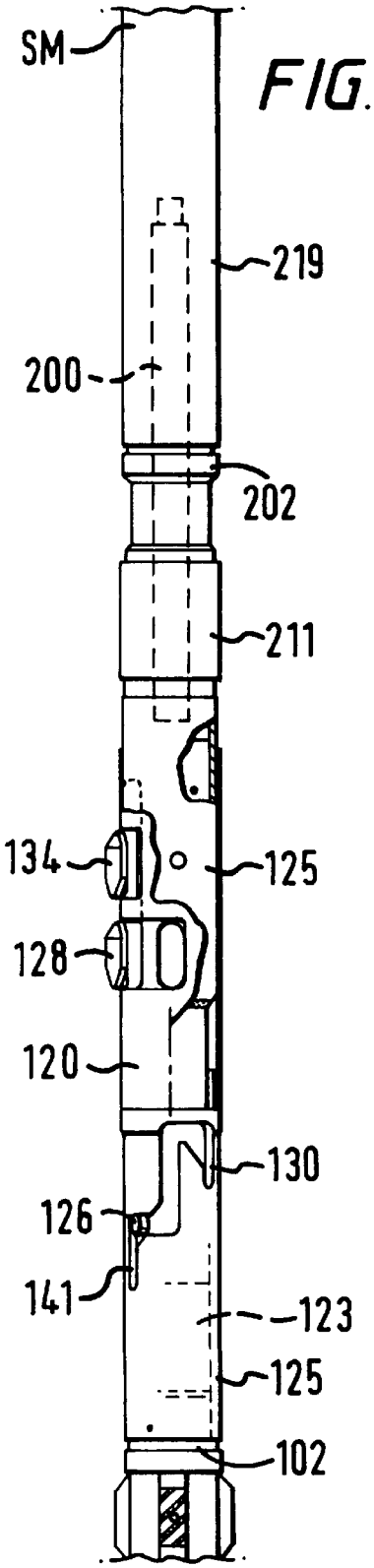

In the position of FIG. 3D the keys 128 and 134 lock the outer sleeve 120 (and therefore the friction mechanism 102) to the rest of the system 100 so that movement of the tubular string with sufficient force moves the entire system 100. Thus, as shown in FIG. 3E, the entire system is moved down so that the key 128 contacts and moves down in the muleshoe slot 130 of the coupling 209. This force breaks the pin 207 (i.e. when the lower key 128 is down in the slot 130 and the upper key 134 has contacted the upper lip of the muleshoe slot). In one aspect, this force also shears the roll pin 203. In another aspect, the roll pin 203 is set to shear at a force (e.g. but not limited to 4500 pounds, 1000 pounds or greater) that is greater than that at which the pin 207 shears (e.g. but not limited to at about 4400 pounds).

Figure 3F:
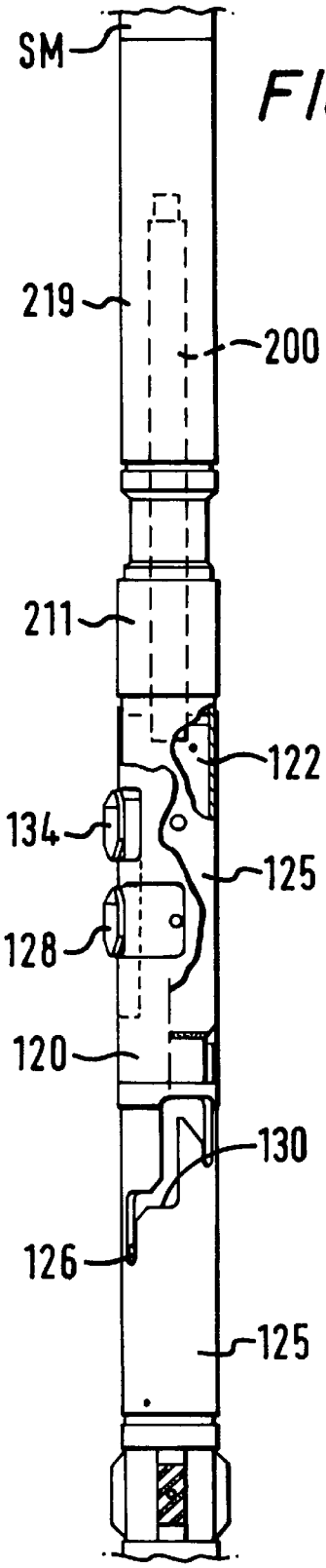
Figure 3G:
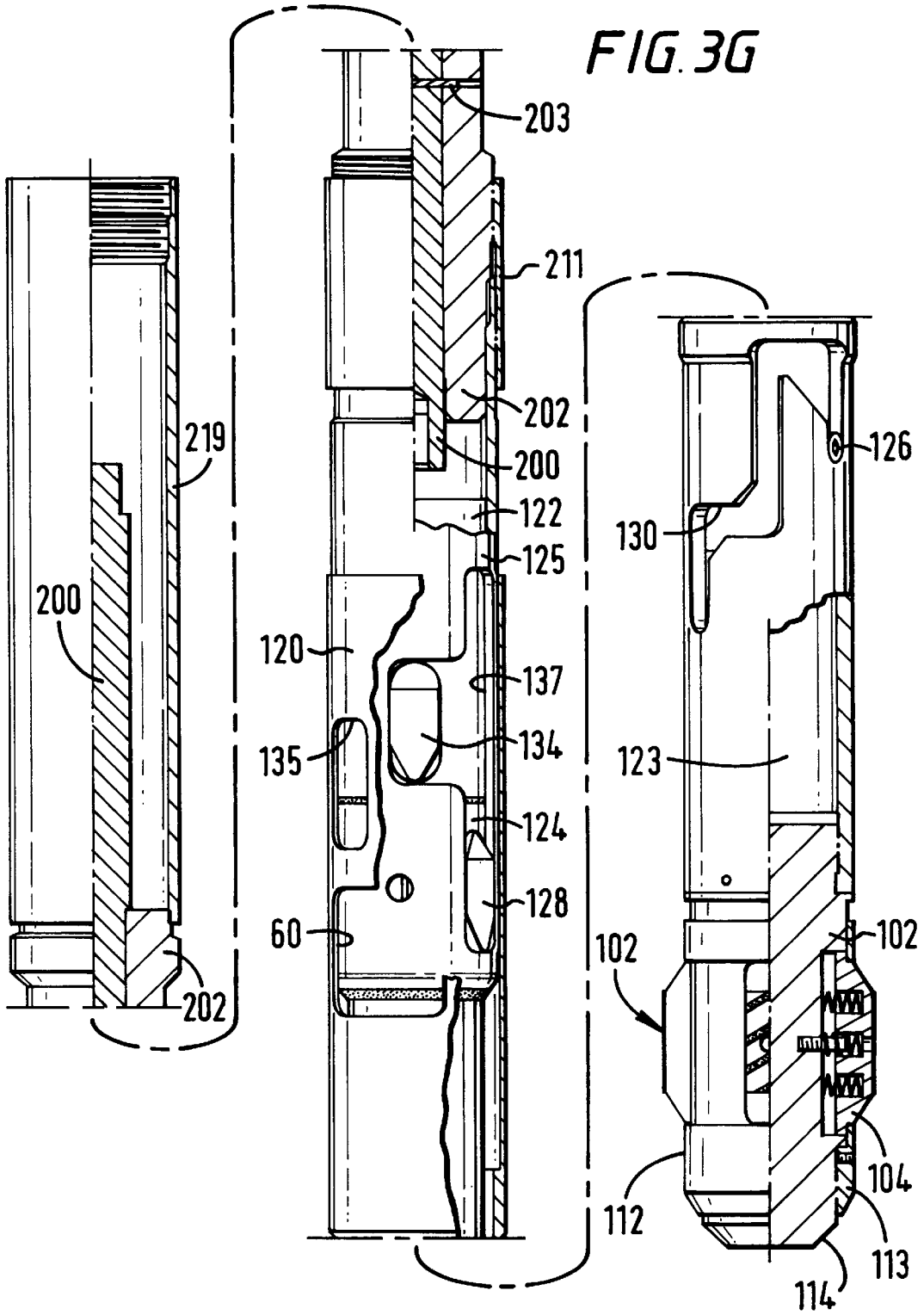
FIG. 3G is an enlargement of FIG. 3A.

As shown in FIG. 3E, the keys 128 and 134 are radially (one-above-the other) aligned and the lug 126 has moved to the position shown in the slot 130. Due to an extended upper part 213 of the window 135 in the tool body 125 and a lower portion 141 of the slot 130, downward movement of the tubular string and the parts connected thereto results in shearing of the roll pin 203 (if not already sheared) so that the trip bar 200 moves down (as shown in FIG. 3F) to abut a top 143 of the upper tubular member 122, beginning the setting sequence for setting of slips (not shown) which are part of the setting mechanism SM. As the trip bar 200 moves down, the keys 128, 134 are locked into the outer sleeve 120 and are also bottomed out in the slot of the coupling 209 (i.e., the keys and outer sleeve are now held immobile). Also the friction mechanism 102 which is threadedly secured to the outer sleeve 120 is mobile.

Figure 7A:
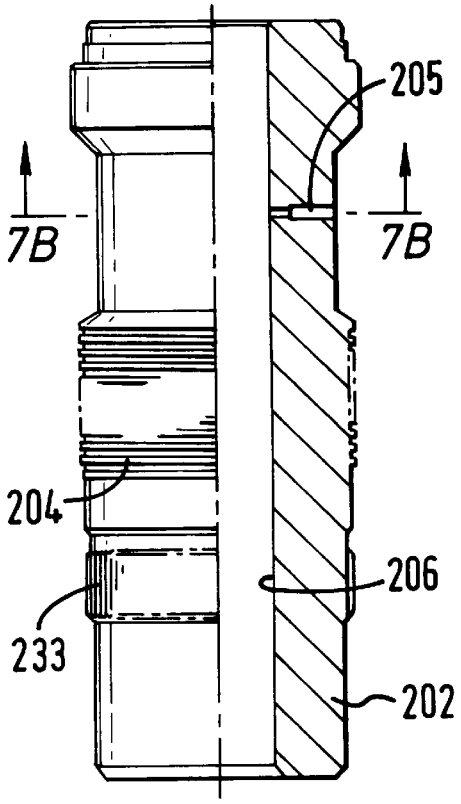
FIG. 7A is a side view half in cross-section of an orientation adapter of the system of FIG. 3A.
Figure 7B:
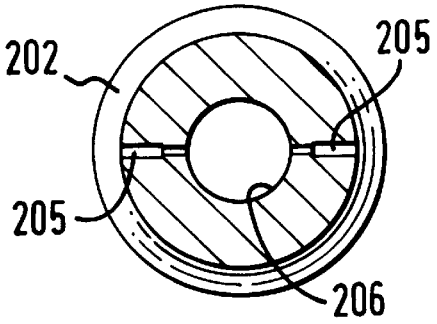
FIG. 7B is a cross-section view along line 7B—7B of FIG. 7A.
Figure 7C:
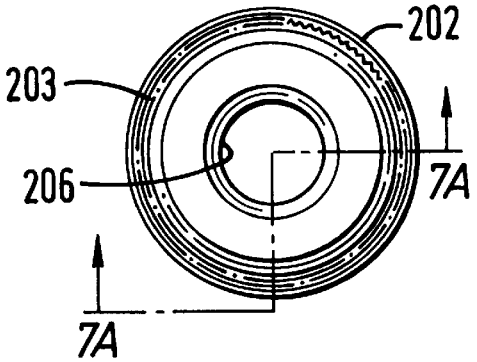
FIG. 7C is a cross-section view of the orientation adapter of FIG. 7A.

FIGS. 7A–7C shown the orientation adapter 202. The adapter 202 has a spline portion 233 that is movable within a portion 219 of the spline nut 211 (see FIG. 8A) when the spline portion 233 is disposed adjacent the portion 219. Threads 204 on the adapter 202 mate with threads 213 of the spline nut 211 and threads 212 of the spline nut 211 mate with exterior threads 159 of the tool body 125. By appropriate positioning of the spline nut 211 with respect to the spline portion 233 of the adapter 202, the adapter 202 is free to rotate so that an item thereabove (e.g. but not limited to a whipstock) can be rotated to achieve a desired orientation. Following correct positioning of the item, the spline nut is again tightened to maintain the correct position of the item; e.g. so that a whipstock is oriented within a wellbore so that a mill will be directed by the whipstock to mill at a desired location of a tubular or so that a drill will drill away from the whipstock at a desired angle. Upon tightening of the spline nut 211, the spline portion 233 of the adapter 202 engages an inner spline portion 157 of the tool body 125. Different pitches on the threads 212 and 213 provide for desired manipulation of the adapter 202 and spline nut 211. For adequate adjustability, in one aspect, the spline portion 203 has a height about half that of the portion 219.

Figure 8A:
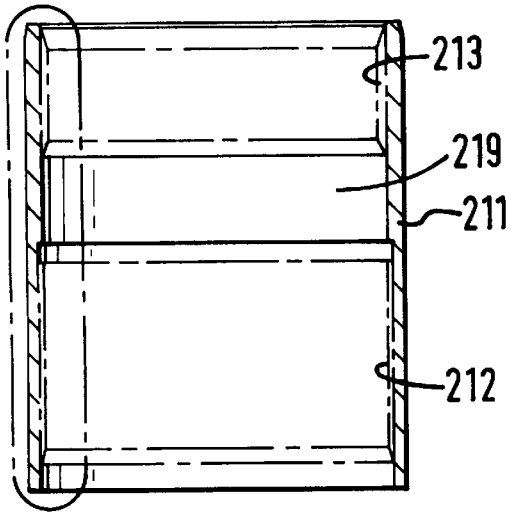
FIG. 8A is a side cross-section view of a spline nut of the system of FIG. 3A.
Figure 8B:
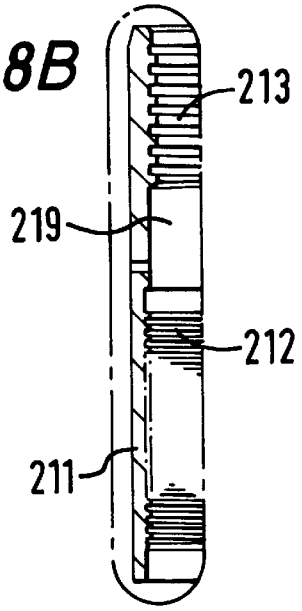
FIG. 8B is a side cross-section view of part of the spline nut of FIG. 8A showing one aspect of profiling on the interior of the spline nut of FIG. 8A.

FIGS. 8A and 8B show the spline nut 211 that connects the orientation adapter 202 and the tool body 125. A bore 214 extends through the spline nut from top to bottom.

FIG. 9 shows the upper tubular member 122 with its key 134. A hole 139 is provided for a bolt (not shown, like the bolt 151, FIG. 10A); and a hole 127 is provided for receiving part of the shear pin 207.

FIGS. 10A–10B show the tubular member 124 with its key 128 and a bolt 151 holding the key 128 movably in its recess 132. As shown in FIGS. 10B and 10C, springs 143 in key recesses 145 and body recesses 143 urge the key 128 outwardly. The 134 (FIG. 9) has similar structure and springs. A bevelled edge 149 facilitates upward movement of the system when the key is projecting from the tool body. A shown in FIGS. 10D–10E a key may have a bevelled edge 149 and a tapered end 155 to facilitate key action and movement. It is within the scope of this invention to use: non-bevelled keys without an end 155; keys with both ends bevelled as at 149 or with both ends like the end 155; and/or a key with either end bevelled as at 149 or with either end like the end 155.

Figure 11A:
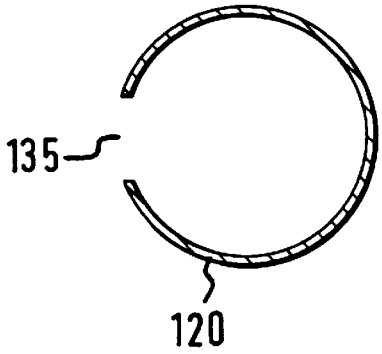
FIG. 11A is a top cross-section view of the outer sleeve of FIG. 5A.
Figure 11B:
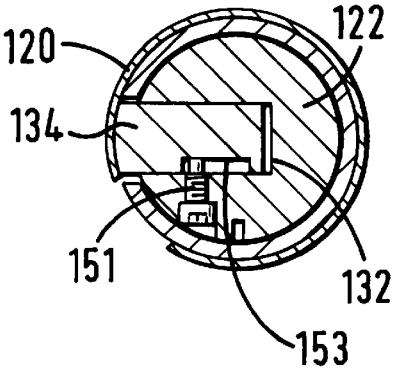
FIG. 11B is a top cross-section view that shows the sleeve of FIG. 11A encompassing a key in a tubular member (as in FIG. 9 or FIG. 10A).
Figure 11C:
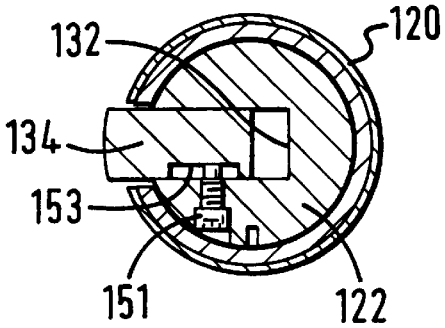
FIG. 11C shows the sleeve of FIG. 11B moved to permit the key to move out of the tubular member.
Figure 5A:
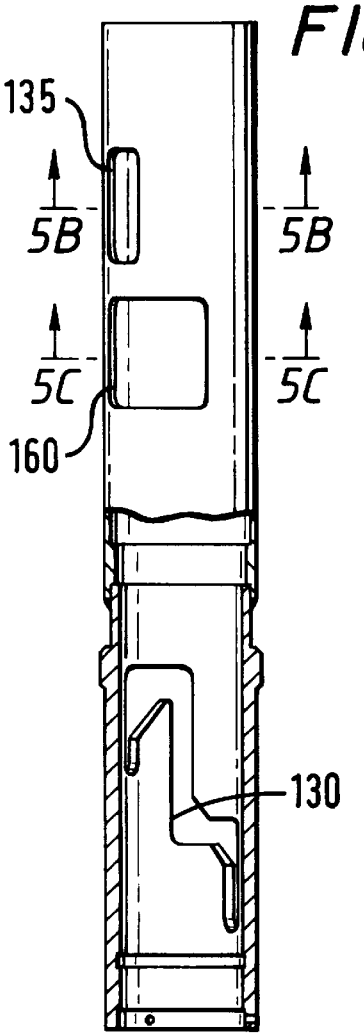
FIG. 5A is a side view partially in cross-section of an outer sleeve of the system of FIG. 3A.
Figure 5B:
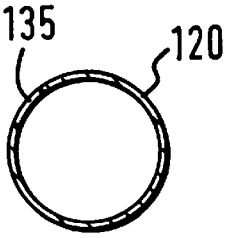
FIG. 5B is a cross-section view along line 5B—5B of FIG. 5A.
Figure 5C:
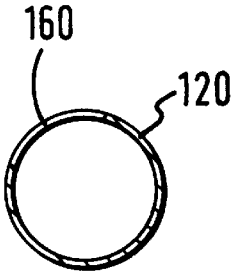
FIG. 5C is a cross-section view along line 5C—5C of FIG. 5A.
Figure 5D:
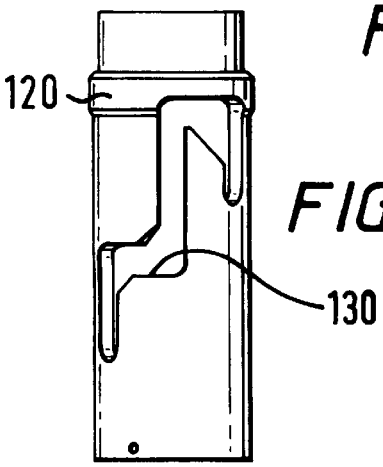
FIG. 5D is an outer side view of part of the sleeve of FIG. 5A.
Figure 6:
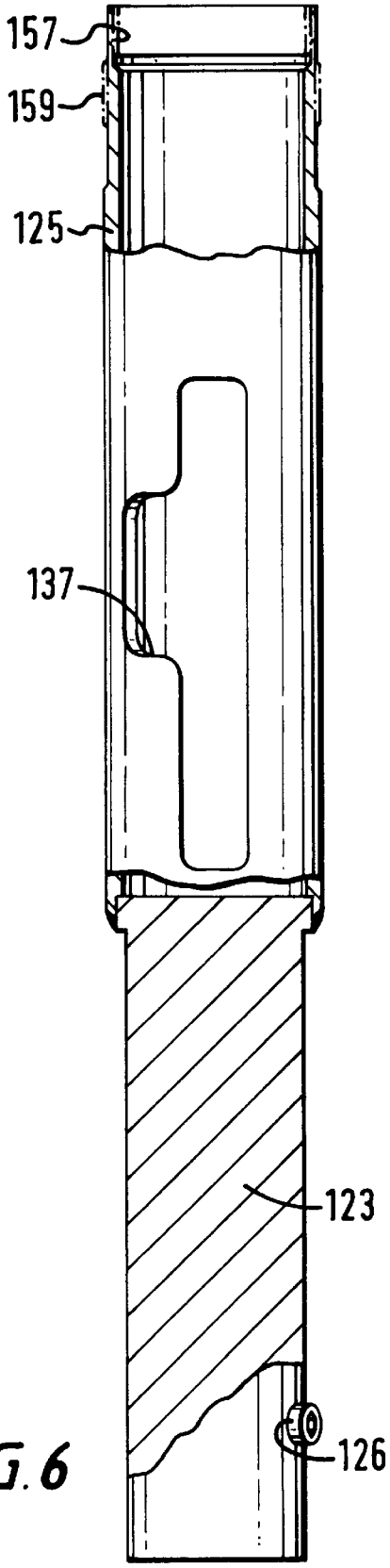
FIG. 6 is a side view partially in cross section of a tool body of the system of FIG. 3A.

FIGS. 11A–11C show the outer sleeve 120 and its relation to the key 134—which is similar to the relation to the key 128. Initially the outer sleeve 120 prevents the keys from projecting outwardly past the outer sleeve 120 (FIG. 11B). With proper system movement, the key 134 is aligned with the window 135 and moves through it (FIG. 11C).

Figure 12A:
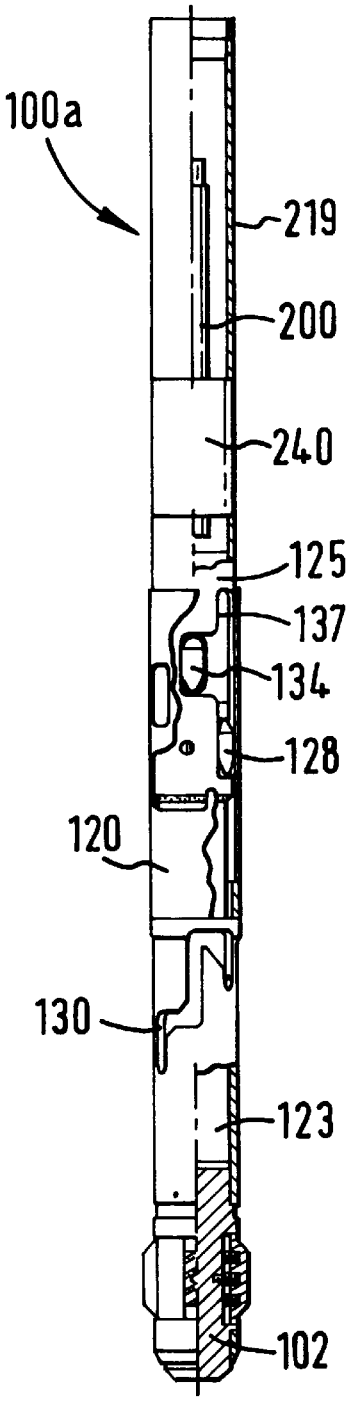
FIGS. 12A and 12B shown alternate embodiments the system 100.
Figure 12B:
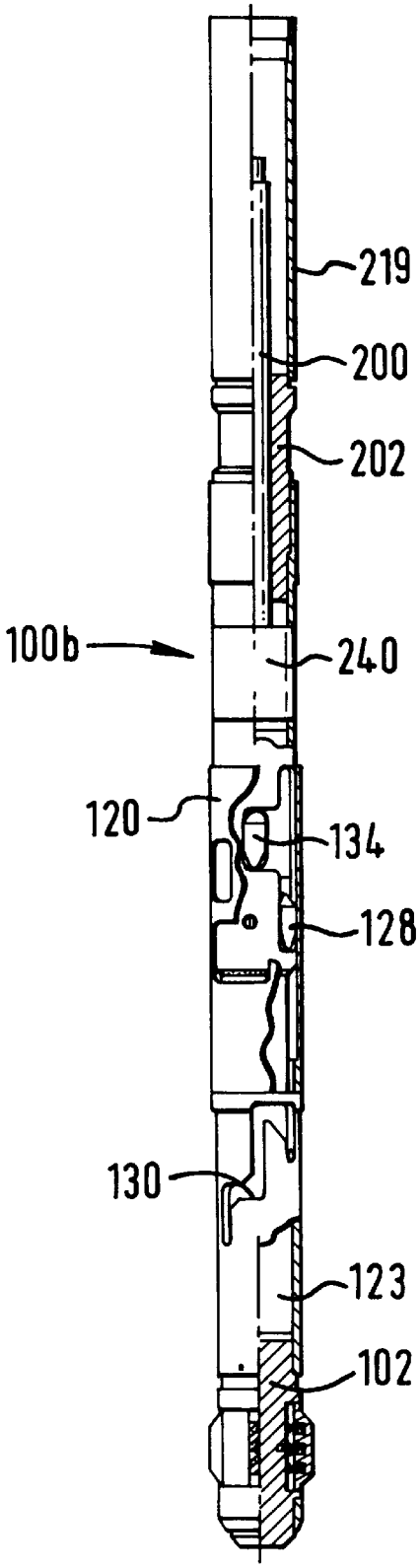

FIGS. 12A and 12B shown alternative embodiments of the system 100. In the system 100*a* of FIG. 12A the orientation adapter 202 is deleted and the trip bar 200 extends through a flexible item, e.g. a flexible coupling 240. In one aspect the flexible coupling 240 is a Powertork (TM) Series F or S gear coupling as is commercially available from Systems Components, Inc. of South Haven, Michigan; however, any suitable flexible item or member may be used in place of the coupling 240 to accommodate bending and/or flexing of the system, including but not limited to a bendable piece of pine, drill pipe, or drill collar.

FIG. 12B shows a system 100*b* which is like the system 100, but with the addition of a flexible coupling 240 (or flexible item or member as discussed above).

The present invention discloses, in certain aspects, a wellbore tool locating system with an optional friction engager for engaging an interior of a wellbore tubular with a bore therethrough from a top to a bottom thereof, an outer sleeve (connected to the friction engager when one is used) having a slot therethrough for controlling movement of an inner body, an inner body movably disposed within the outer sleeve for both rotating and up-and-down movement therein, a lug projecting out from the inner body and movably disposed in the slot, at least one key in a recess in the body, the at least one key urged outwardly by a spring therebehind, the at least one key initially held in its recess by contacting an inner surface of the outer sleeve, at least one window through the outer sleeve, and the inner body movable to align the at least one key with the at least one window to release the at least one key to move from its recess to project through the at least one window and beyond an exterior surface of the outer sleeve for engaging a profile on the wellbore tubular; such a tool locating system wherein there are at least two extendable keys offset from each other and disposed so that an interconnected setting mechanism is settable only after the wellbore tool locating system is correctly oriented; and such a system usable with a setting mechanism, and/or with a mill releasably connected to a whipstock; and any such wellbore tool locating system wherein the friction engager engaging the interior of the wellbore tubular isolates the profile of the wellbore tubular from the weight of the system.

The present invention discloses, in certain aspects, a method for locating an item in a first tubular of a tubular string in an earth wellbore, the tubular string including a second tubular with a profile interiorly thereof, the item connected to a wellbore tool locating system as described herein, the method including engaging the tubular string with a friction engager, moving an inner body of the system so that its lug moves and said movement is governed by the slot in the outer sleeve, aligning at least one key of the system with at least one window of an outer sleeve of the system by moving the inner body, extending the at least one key through the outer sleeve to project therebeyond to engage the profile of the second tubular, and moving the at least one key with respect to the profile to locate the item within the tubular string; such a method including setting a setting mechanism interconnected with the system and located within the tubular string only after the wellbore tool locating system is correctly oriented; such a method including milling a tubular of the tubular string with a mill; such a method including milling a window through the tubular string with the mill, and making a lateral wellbore extending into earth adjacent the window.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore tool locating system comprising a friction engager for engaging an interior of a wellbore tubular with a bore therethrough from a top to a bottom thereof, an outer sleeve connected to the friction engager and having a slot therethrough for controlling movement of an inner body, an inner body movably disposed within the outer sleeve for both rotating and up-and-down movement therein, a lug projecting out from the inner body and movably disposed in the slot, at least one key in a recess in the body, the at least one key urged outwardly by a spring therebehind, the at least one key initially held in its recess by contacting an inner surface of the outer sleeve, at least one window through the outer sleeve, and the inner body movable to align the at least one key with the at least one window to release the at least one key to move from its recess to project through the at least one window and beyond an exterior surface of the outer sleeve for engaging a profile on the wellbore tubular.

2. The wellbore tool locating system of claim 1 further comprising the inner body comprising a first tubular member disposed below a second tubular member, the at least one key comprising a first key in a recess in the first tubular member and a second key in a recess in the second tubular member, the at least one window comprising a first window through which the first key is extendable and a second window through which the second key is extendable, the first window spaced-apart from the second window, and the keys selectively extendable to contact the profile.

3. The wellbore tool locating system of claim 2 wherein the first window is radially offset from and positioned below the second window.

4. The wellbore tool locating system of claim 3 wherein the first window is wider than the second window so that the first key is movable to contact the profile and move downwardly therein prior to the second key contacting the profile.

5. The wellbore tool locating system of claim 4 further comprising a setting mechanism connected to and above the wellbore tool locating system.

6. The wellbore tool locating system of claim 5 wherein the setting mechanism has a trip bar therein for activating at least one setting member, the trip bar releasably secured to the setting mechanism by a shear member, the trip bar following release movable to contact the second tubular member so that force of the trip bar against the second tubular member shears the shear member.

7. The wellbore tool locating system of claim 6 wherein the keys and their respective tubular members are disposed so that the trip bar is movable to contact the second tubular member only after the wellbore tool locating system is correctly oriented.

8. The wellbore tool locating system of claim 1 further comprising a wellbore apparatus connected to and above the inner body.

9. The wellbore tool locating system of claim 8 further comprising a flexible member connected between the inner body and the wellbore apparatus.

10. The wellbore tool locating system of claim 8 wherein the wellbore apparatus is a whipstock.

11. The wellbore tool locating system of claim 10 further comprising a mill releasably connected to the whipstock.

12. The wellbore tool locating system of claim 11 further comprising a tubular string to which the mill is connected.

13. The wellbore tool locating system of claim 10 further comprising setting apparatus connected to the whipstock for anchoring the whipstock within a tubular string, the tubular string interconnected with the wellbore tubular engaged by the friction engager.

14. The wellbore tool locating system of claim 13 wherein the setting apparatus has a trip bar therein for activating at least one setting member, the trip bar releasably secured to the setting mechanism by a shear member, the trip bar following release movable to contact the second tubular member so that force of the trip bar against the second tubular member shears the shear member.

15. The wellbore tool locating system of claim 14 the keys and their respective tubular members are disposed so that the trip bar is movable to contact the second tubular member only after the second key contacts the profile.

16. The wellbore tool locating system of claim 1 wherein the wellbore tubular's profile is a muleshoe slot with upper tapered portions on either side of a lower slot portion, the upper tapered portions for guiding the lug down into the lower slot portion.

17. The wellbore tool locating system of claim 1 wherein the wellbore tubular's bore has an inner diameter and the profile is positioned beyond said inner diameter so that the profile does not project into the bore.

18. The wellbore tool locating system of claim 1 wherein the friction engager engaging the interior of the wellbore tubular isolates the profile of the wellbore tubular from weight of the system.

19. A wellbore tool locating system of claim 1 wherein the wellbore tubular supports the weight of the wellbore tool locating system.

20. A wellbore system comprising a friction engager for engaging an interior of a wellbore tubular with a bore therethrough from a top to a bottom thereof, an outer sleeve connected to the friction engager and having a slot therethrough for controlling movement of an inner body an inner body movably disposed within the outer sleeve for both rotating and up-and-down movement therein, the inner body comprising a first tubular member disposed below a second tubular member, a lug projecting out from the inner body and movably disposed in the slot, at least one key in a recess in the body, the at least one key urged outwardly by a spring therebehind, the at least one key initially held in its recess by contacting an inner surface of the outer sleeve, the at least one key comprising a first key in a recess in the first tubular member and a second key in a recess in the second tubular member, at plurality of windows through the outer sleeve, the plurality of windows comprising a first window through which the first key is extendable and a second window through which the second key is extendable, and the inner body movable to align the at least one key with the at least one window to release the at least one key to move from its recess to project through the at least one window and beyond an exterior surface of the outer sleeve for engaging a profile on the wellbore tubular, the first window spaced-apart from and radially offset from and positioned below the second window, and the keys selectively extendable to contact the profile, the first window wider than the second window so that the first key is movable to contact the profile and move therein prior to the second key contacting the profile, a setting mechanism connected to and above the wellbore tool locating system, the setting mechanism having a trip bar therein for activating at least one setting member, the trip bar releasably secured to the setting mechanism by a shear member, the trip bar following release movable to contact the second tubular member so that force of the trip bar against the second tubular member shears the shear member, a whipstock connected to the setting mechanism, a mill releasably connected to the whipstock, and a tubular string to which the mill is connected.

21. A wellbore tool locating system comprising an outer sleeve having a slot therethrough for controlling movement of an inner body, an inner body movably disposed within the outer sleeve for both rotating and up-and-down movement therein, a lug projecting out from the inner body and movably disposed in the slot, at least one key in a recess in the body, the at least one key urged outwardly by a spring therebehind, the at least one key initially held in its recess by contacting an inner surface of the outer sleeve, at least one window through the outer sleeve, and the inner body movable to align the at least one key with the at least one window to release the at least one key to move from its recess to project through the at least one window and beyond an exterior surface of the outer sleeve for engaging a profile on a wellbore tubular.

22. The wellbore tool locating system of claim 21 the inner body comprising a first tubular member disposed below a second tubular member, the at least one key comprising a first key in a recess in the first tubular member and a second key in a recess in the second tubular member, the at least one window comprising a first window through which the first key is extendable and a second window through which the second key is extendable, the first window spaced-apart from the second window, and the keys selectively extendable to contact the profile.

23. The wellbore tool locating system of claim 22 wherein the first window is radially offset from and positioned below the second window.

24. The wellbore tool locating system of claim 23 wherein the first window is wider than the second window so that the first key is movable to contact the profile and move downwardly therein prior to the second key contacting the profile.

25. The wellbore tool locating system of claim 24 further comprising a setting mechanism connected to and above the wellbore tool locating system.

26. The wellbore tool locating system of claim 25 wherein the setting mechanism has a trip bar therein for activating at least one setting member, the trip bar releasably secured to the setting mechanism by a shear member, the trip bar following release movable to contact the second tubular member so that force of the trip bar against the second tubular member shears the shear member.

27. The wellbore tool locating system of claim 26 wherein the keys and their respective tubular members are disposed so that the trip bar is movable to contact the second tubular member only after the wellbore tool locating system is correctly oriented.

28. The wellbore tool locating system of claim 21 wherein the wellbore tubular supports the weight of the wellbore tool locating system.

29. A wellbore system comprising an outer sleeve having a slot therethrough for controlling movement of an inner body, an inner body movably disposed within the outer sleeve for both rotating and up-and-down movement therein, the inner body comprising a first tubular member disposed below a second tubular member, a lug projecting out from the inner body and movably disposed in the slot, at least one key in a recess in the body, the at least one key urged outwardly by a spring therebehind, the at least one key initially held in its recess by contacting an inner surface of the outer sleeve, the at least one key comprising a first key in a recess in the first tubular member and a second key in a recess in the second tubular member, at plurality of windows through the outer sleeve, the plurality of windows comprising a first window through which the first key is extendable and a second window through which the second key is extendable, the inner body movable to align the at least one key with the at least one window to release the at least one key to move from its recess to project through the at least one window and beyond an exterior surface of the outer sleeve for engaging a profile on the wellbore tubular, the first window spaced-apart from and radially offset from and positioned below the second window, and the keys selectively extendable to contact the profile, the first window wider than the second window so that the first key is movable to contact the profile and move therein prior to the second key contacting the profile, a setting mechanism connected to and above the wellbore tool locating system, the setting mechanism having a trip bar therein for activating at least one setting member, the trip bar releasably secured to the setting mechanism by a shear member, the trip bar following release movable to contact the second tubular member so that force of the trip bar against the second tubular member shears the shear member, a whipstock connected to the setting mechanism, a mill releasably connected to the whipstock, and a tubular string to which the mill is connected.

30. A method for locating an item in a first tubular of a tubular string in an earth wellbore, the tubular string including a second tubular with a profile interiorly thereof, the item connected to a wellbore tool locating system comprising a friction engager for engaging an interior of a wellbore tubular with a bore therethrough from a top to a bottom thereof, an outer sleeve connected to the friction engager and having a slot therethrough for controlling movement of an inner body, an inner body movably disposed within the outer sleeve for both rotating and up-and-down movement therein, a lug projecting out from the inner body and movably disposed in the slot, at least one key in a recess in the body, the at least one key urged outwardly by a spring therebehind, the at least one key initially held in its recess by contacting an inner surface of the outer sleeve, at least one window through the outer sleeve, and the inner body movable to align the at least one key with the at least one window to release the at least one key to move from its recess to project through the at least one window and beyond an exterior surface of the outer sleeve for engaging a profile on the wellbore tubular, the method comprising engaging the tubular string with the friction engager, moving the inner body so that its lug moves and said movement is governed by the slot in the outer sleeve, aligning the at least one key with the at least one window of the outer sleeve by moving the inner body, extending the at least one key through the outer sleeve to project therebeyond to engage the profile of the second tubular, and moving the at least one key with respect to the profile to locate the item within the tubular string.

31. The method of claim 30 wherein the inner body comprising a first tubular member disposed below a second tubular member, the at least one key comprising a first key in a recess in the first tubular member and a second key in a recess in the second tubular member, the at least one window comprising a first window through which the first key is extendable and a second window through which the second key is extendable, the first window spaced-apart from the second window, and the keys selectively extendable to contact the profile, the first window is radially offset from and positioned below the second window, the first window is wider than the second window so that the first key is movable to contact the profile and move downwardly therein prior to the second key contacting the profile, a setting mechanism connected to and above the wellbore tool locating system, the setting mechanism has a trip bar therein for activating at least one setting member, the trip bar releasably secured to the setting mechanism by a shear member, the trip bar following release movable to contact the second tubular member so that force of the trip bar against the second tubular member shears the shear member, the keys and their respective tubular members are disposed so that the trip bar is movable to contact the second tubular member only after the wellbore tool locating system is correctly oriented, the method further comprising setting the setting mechanism within the tubular string only after the wellbore tool locating system is correctly oriented.

32. The method of claim 31 further comprising milling a window opening through the tubular string with the mill, and making a lateral wellbore extending into earth adjacent the window opening.

33. The method of claim 30 wherein a wellbore apparatus is connected to and above the inner body, the wellbore apparatus is a whipstock, a mill releasably connected to the whipstock, and a tubular string to which the mill is connected, the method further comprising milling a tubular other than the first tubular of the tubular string with the mill.

* * * * *